US007681377B2

(12) United States Patent
Simmons et al.

(10) Patent No.: US 7,681,377 B2
(45) Date of Patent: Mar. 23, 2010

(54) DEVICE FOR FORMING PARTITIONED FILM PACKAGES

(75) Inventors: Walter John Simmons, Martinsburg, WV (US); Walter Neal Simmons, Durham, NC (US); John G. Oldsen, Butler, PA (US)

(73) Assignee: J-Lok Co., Pittsburgh, PA (US)

( * ) Notice: Subject to any disclaimer, the term of this patent is extended or adjusted under 35 U.S.C. 154(b) by 333 days.

(21) Appl. No.: 11/472,798

(22) Filed: Jun. 22, 2006

(65) Prior Publication Data

US 2007/0017832 A1 Jan. 25, 2007

Related U.S. Application Data

(60) Provisional application No. 60/693,576, filed on Jun. 24, 2005.

(51) Int. Cl.
*B65B 9/00* (2006.01)

(52) U.S. Cl. ..... 53/451; 53/452; 53/551; 493/294

(58) Field of Classification Search ..... 53/451, 53/452, 551, 560, 550, 553, 449, 474, 170; 493/294, 302, 931
See application file for complete search history.

(56) References Cited

U.S. PATENT DOCUMENTS

| | | | | | |
|---|---|---|---|---|---|
| 2,154,521 | A * | 4/1939 | Maxfield | ..... | 53/449 |
| 3,210,907 | A | 10/1965 | Thurlings | | |
| 3,795,081 | A | 3/1974 | Brown, Jr. et al. | | |
| 3,889,446 | A | 6/1975 | Simmons et al | | |
| 3,918,235 | A * | 11/1975 | Brown et al. | ..... | 53/451 |
| 4,495,748 | A | 1/1985 | Rowell | | |
| 5,832,700 | A * | 11/1998 | Kammler et al. | ..... | 53/502 |
| 6,237,308 | B1 * | 5/2001 | Quintin et al. | ..... | 53/451 |
| 7,059,102 | B2 * | 6/2006 | Hanten | ..... | 53/450 |

* cited by examiner

*Primary Examiner*—Sameh H. Tawfik
(74) *Attorney, Agent, or Firm*—The Webb Law Firm

(57) ABSTRACT

A process for producing partitioned packages by which a first film is formed into an elongated inner tube and a second film is formed into an elongated outer tube surrounding the inner tube. Reactive components are filled into the inner and outer tubes as the tubes are formed to maintain the reactive components separate from each other. Only the outer tube is actively engaged to advance the tube longitudinally. Frictional forces from the advancing outer tube are applied to the component within the outer tube and, in turn, are applied to the inner tube thereby advancing the inner tube at a rate substantially the same as the outer tube.

9 Claims, 4 Drawing Sheets

DEVICE FOR FORMING PARTITIONED FILM PACKAGES

CROSS REFERENCE TO RELATED APPLICATIONS

This application claims the benefit of U.S. Provisional Application No. 60/693,576, entitled "Device for Forming Partitioned Film Packages", filed Jun. 24, 2005, and herein incorporated by reference in its entirety.

BACKGROUND OF THE INVENTION

1. Field of the Invention

The present invention is directed to a process for producing tubular film packages having a partition to maintain different materials on either side of the partition. More particularly, the present invention is directed to a method of producing mine roof bolt resin packages in which a polymerizable resin component an a catalyst are temporarily maintained on opposing sides of a partition in a tubular package.

2. Description of Related Art

Mine roof bolts and other structural elements are often anchored into rock, concrete or the like by a combination of adhesives and mechanical structures such as an expansion anchor at the distal end of the bolt. Adhesives are generally formed in place within the borehole by providing a resin cartridge that is a dual compartment package containing a polymerizable resin in one compartment and a hardener or catalyst in another compartment. A borehole is drilled in the rock and the cartridge containing the polymerizable resin and catalyst is inserted into the blind end of the borehole. When a mine roof bolt is inserted into the borehole, the distal end of the bolt ruptures the package so that the resin and catalyst are mixed. Typically, the bolt is rotated to enhance mixing until the resin hardens to a degree that the bolt can no longer be rotated and the resin is allowed to cure.

In these two component packages, it is critical that the polymerizable resin and the catalyst are maintained separate from each other until the package is ruptured during installation of the mine roof bolt. Some resin cartridges include an inner compartment containing catalyst surrounded by an outer compartment containing the polymerizable resin. Other resin cartridges employ a barrier to divide a container into two compartments with the catalyst and resin on opposing sides of the barrier. In an aggressive environment such as an underground mine, resin cartridges are often produced from strong films such as polyethylene terephthalate, such as Mylar®. Polyethylene terephthalate provides the desired structural integrity to the resin cartridge, yet is more costly than other pliable films that may be used in less aggressive environments. Conventional resin cartridges often use polyethylene terephthalate for the outer compartment as well as the inner compartment of the barrier, even though these inner structures are not exposed to the underground mine environment and do not require the structural integrity of the outer compartment.

Resin cartridges are produced via various techniques. For example, a resin cartridge having an interior barrier for separating the reactive components can be produced by forming a web of film into an advancing tube with the edges of the tube overlapping each other to produce a tube with an inner web spanning the diameter of the tube. The web is sealed to the tube thereby creating two adjacent compartments with the web being common to both compartments as a barrier. Resin cartridges with a barrier layer that spans a tube have also been produced by forming an advancing tube using a cylindrical forming member. As the tube advances, a strip of film material is advanced through the tube and heat sealed to opposing sides of the tube. However, the heat seals between the barrier and the tubing present an opportunity for failure of the resin cartridge and premature mixing of the polymerizable resin and catalyst.

Alternatively, two compartment packages can be formed by drawing a web of film into a cylindrical forming member to bring the web's edges together in an overlapping relationship and advancing the resulting first tube past the forming member. A second web of pliable film is fed through another forming member to produce a second tube that advances within the advancing first tube at a rate substantially equal to the rate of advancing of the first tube. The first tube is advanced by pinching the edges of the first tube between two pairs of opposing rollers, and the second tube is advanced by similarly pinching the edges of the second tube between two pairs of opposing rollers. This process requires that the advancing rollers for the first tube and the advancing rollers for the second tube are properly matched so both tubes advance at the same rate.

SUMMARY OF THE INVENTION

The present invention provides a method and apparatus for producing a partitioned package having an inner tube containing a first material and an outer tube containing a second material, where the outer tube is advanced, thereby causing the material within the outer tube to advance and drag the inner tube along therewith at substantially the same rate. Only the outer tube is engaged by the apparatus, yet the apparatus produces a partitioned compartment where all components are advanced substantially similar rates. The method and apparatus of the present invention are particularly suited for producing resin cartridges for use in anchoring mine roof bolts where the inner tube is manufactured from a weaker material than the outer tube. Such an arrangement reduces the cost of materials and minimizes the force needed to puncture the inner tube which provides for more rapid mixing of the resin cartridge components.

DETAILED DESCRIPTION OF THE INVENTION

Figure 1:
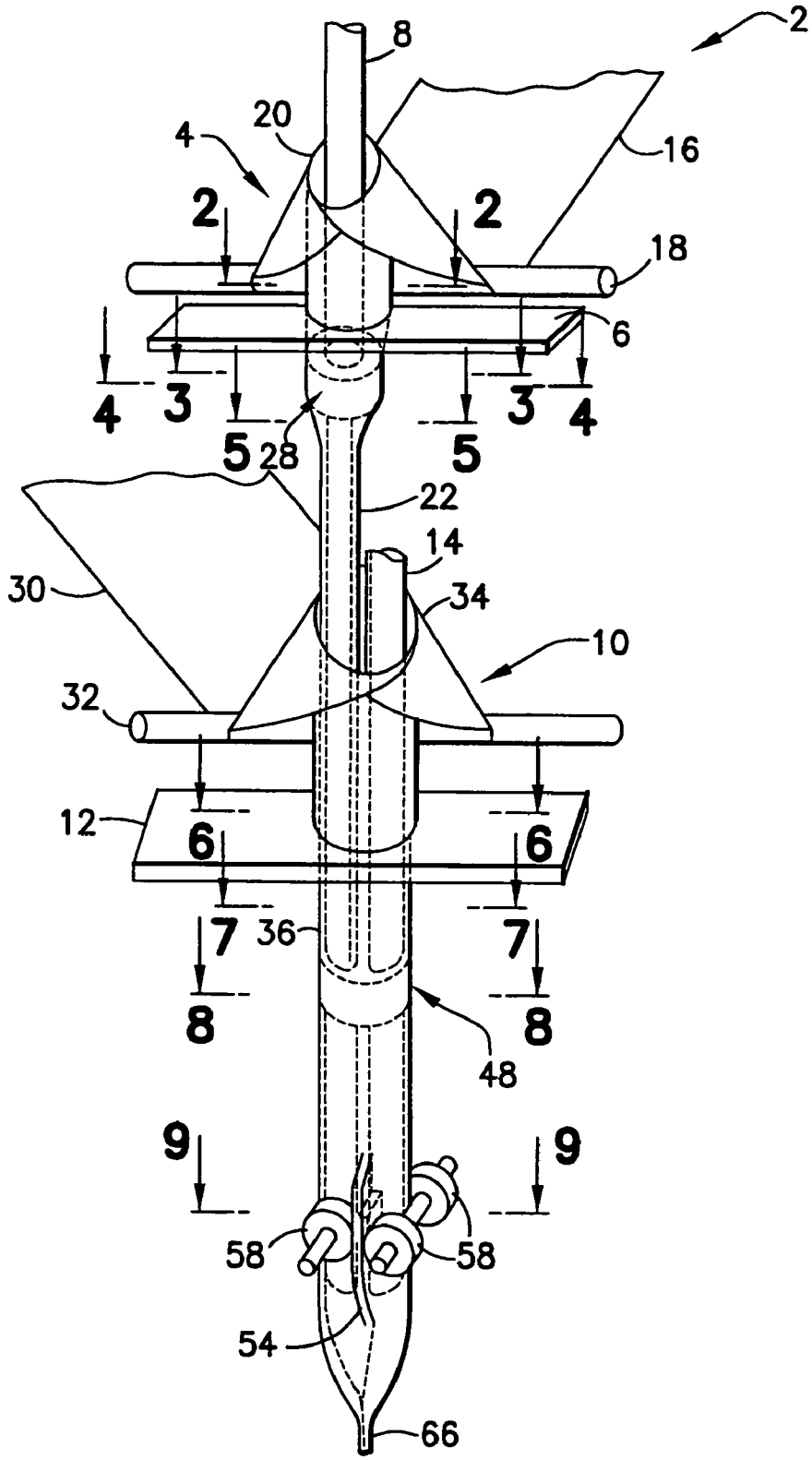
FIG. 1 is a perspective view of a packaging device advancing a tube received within a larger tube made in accordance with the present invention.

The present invention is described with reference to producing two-component cartridges containing resin and a catalyst component for effecting polymerization of the resin upon rupture of the cartridge and mixing of the components, particularly for use in anchoring mine roof bolts. However, this use is exemplary only and is not meant to be limiting. The resin cartridges produced using the present invention may be used to anchor other structural components. Additionally, the two-component cartridge of the present invention may be used for housing other components that may or may not be reactive with each other. For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
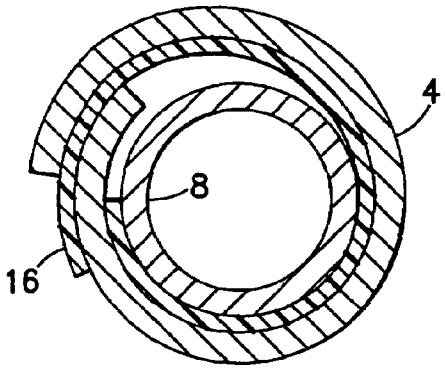
FIG. 2 is a cross-section of the device shown in FIG. 1 taken along line 2-2.
Figure 4:
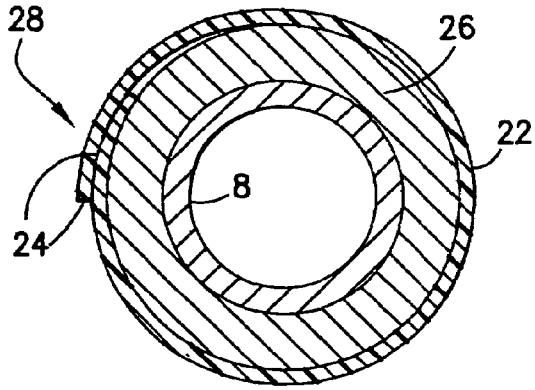
FIG. 4 is a cross-section of the device shown in FIG. 1 taken along line 4-4.
Figure 3:
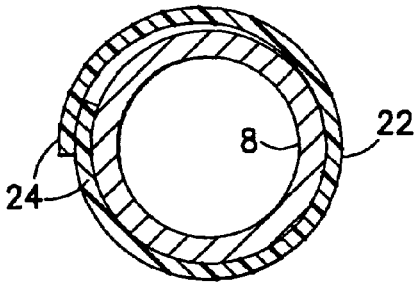
FIG. 3 is a cross-section of the device as shown in FIG. 1 taken along line 3-3.
Figure 5:
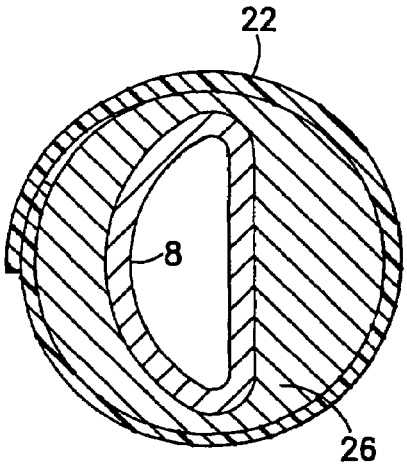
FIG. 5 is a cross-section of the device shown in FIG. 1 taken along line 5-5.

Referring to FIG. 1, the apparatus 2 of the present invention includes a first forming member 4 mounted on a support 6 and surrounding a first fill tube 8 and a second forming member 10 mounted on a support 12 and surrounding both of a second fill tube 14 and the first fill tube 8. A web 16 of a first pliable film moves continuously from a supply roll (not shown) and passes under at least one roller 18 and upwardly and over a curved edge 20 of the first forming member 4. The first forming member 4 is cut and shaped to cause the first web 16 to reverse its direction and to guide edges of the first web 16 downwardly into a convoluted tube forming relation around the first fill tube 8 as shown in FIG. 2. As the first web 16 travels down the outside of the first fill tube 8, the edges of the web 16 overlap yielding an inner tube 22 with longitudinally extending overlapping portions 24 as shown in FIG. 3. The inner tube 22 advances over a first collar 26 having a larger cross-sectional dimensions than the first fill tube 8, as shown in FIG. 4. The first fill tube 8 and the first collar 26 may have cylindrical cross-sections as shown in FIG. 4 at the upper end of first collar 26. At the lower end of first collar 26 as shown in FIG. 5, the cross-sectional configurations of both of the first collar 26 and the first fill tube 8 are altered. At this location, the first fill tube 8 has a non-circular configuration and the collar 26 has a cylindrical exterior surface and an interior configuration that corresponds to the configuration of the first fill tube 8. A heat seal is applied at 28 to the overlapping portions 24 to seal the inner tube 22.

Figure 6:
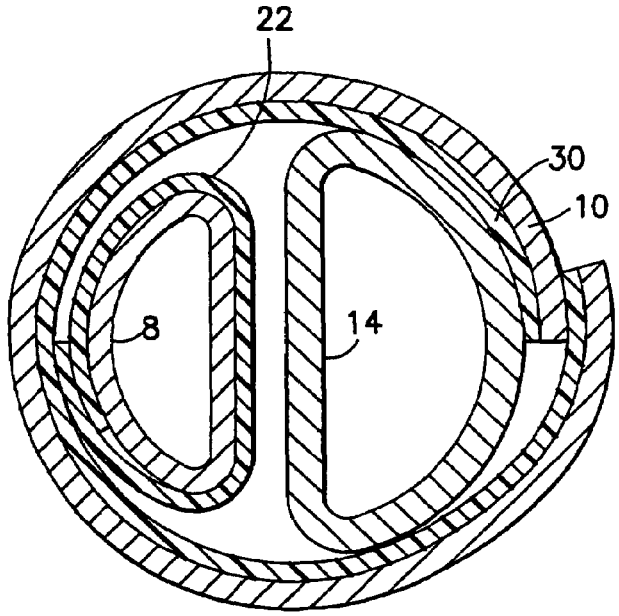
FIG. 6 is a cross-section of the device shown in FIG. 1 taken along line 6-6.
Figure 7:
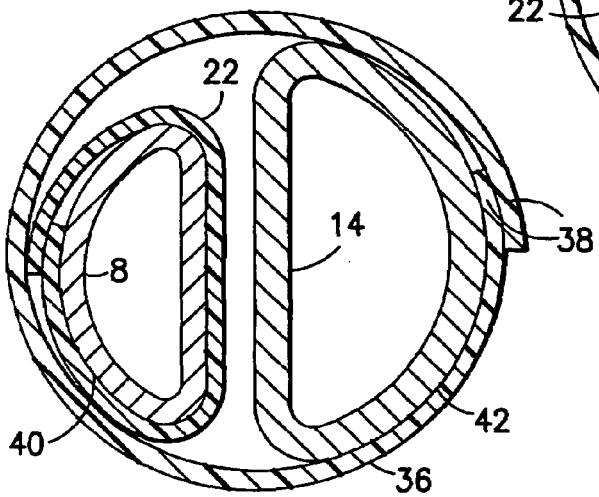
FIG. 7 is a cross-section of the device shown in FIG. 1 taken along line 7-7.

Referring to FIGS. 6 and 7, a second web 30 of pliable film extends over a roller 32 and upwardly and over an upper curved edge 34 of the second forming member 10 to surround both the inner tube 22 (and the first fill tube 8) and the second fill tube 14. The second fill tube 14 has a non-circular configuration and may generally have larger cross-sectional dimensions than the first fill tube 8. As the second web 30 travels past the second forming member 10 along the outside surfaces of the inner tube 22 and second fill tube 14, an outer tube 36 is formed from the second web 30 in an overlapping relationship with the second forming member 10. The first and second fill tubes 8 and 14 have respective curved portions 40 and 42 that together generally provide a curved surface onto which the outer tube 36 is formed with longitudinally extending overlapping portions 38.

Figure 8:
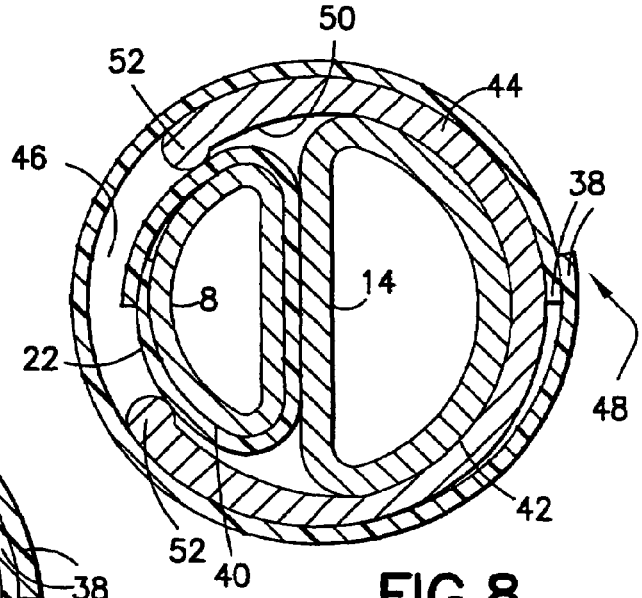
FIG. 8 is a cross-section of the device shown in FIG. 1 taken along line 8-8.

As shown in FIG. 8, the outer tube 36 passes over a second collar 44 having a longitudinal slot 46. A heat seal is applied at 48 to the overlapping portions 38 of the outer tube 36. The overlapping portions 24 of the inner tube 22 and the overlapping portions 38 of the outer tube 36 may be positioned at different radial positions so that the heat seal produced on the outer tube 36 has minimal impact on the previously produced heat seal of the inner tube 22. The inner surface 50 of the second collar 44 is configured to correspond to the curved exterior surface 42 of the second fill tube 14 and frictionally engage the first fill tube 8. The second collar 44 may include enlarged portions 52 that are sized and configured to exert sufficient force against the inner tube 22 and the first fill tube 8 so as to retain the fill tubes 8 and 14 and the first tube 22 within the second collar 44. Alternatively, the second collar 44 may be fixed to the second fill tube 14 along a portion of surface 42 such as by welding.

Figure 9:
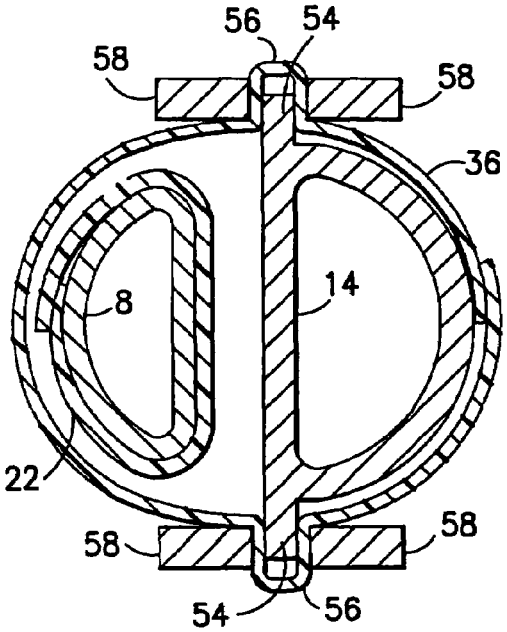
FIG. 9 is a cross-section of the device shown in FIG. 1 taken along line 9-9.

At a lower end of the package forming apparatus 2, the first full tube 8 and the second fill tube 14 have reduced cross-sectional dimensions. In one embodiment, fins 54 extend from opposing sides of the second fill tube 14 as shown in FIG. 9. Opposing portions 56 of the outer tube 36 are each engaged between a fin 54 and a pair of feed wheels 58. The feed wheels 58 engage the outer tube 36 for continuous advancement thereof towards a tube constricting and sealing unit (not shown).

Figure 12:
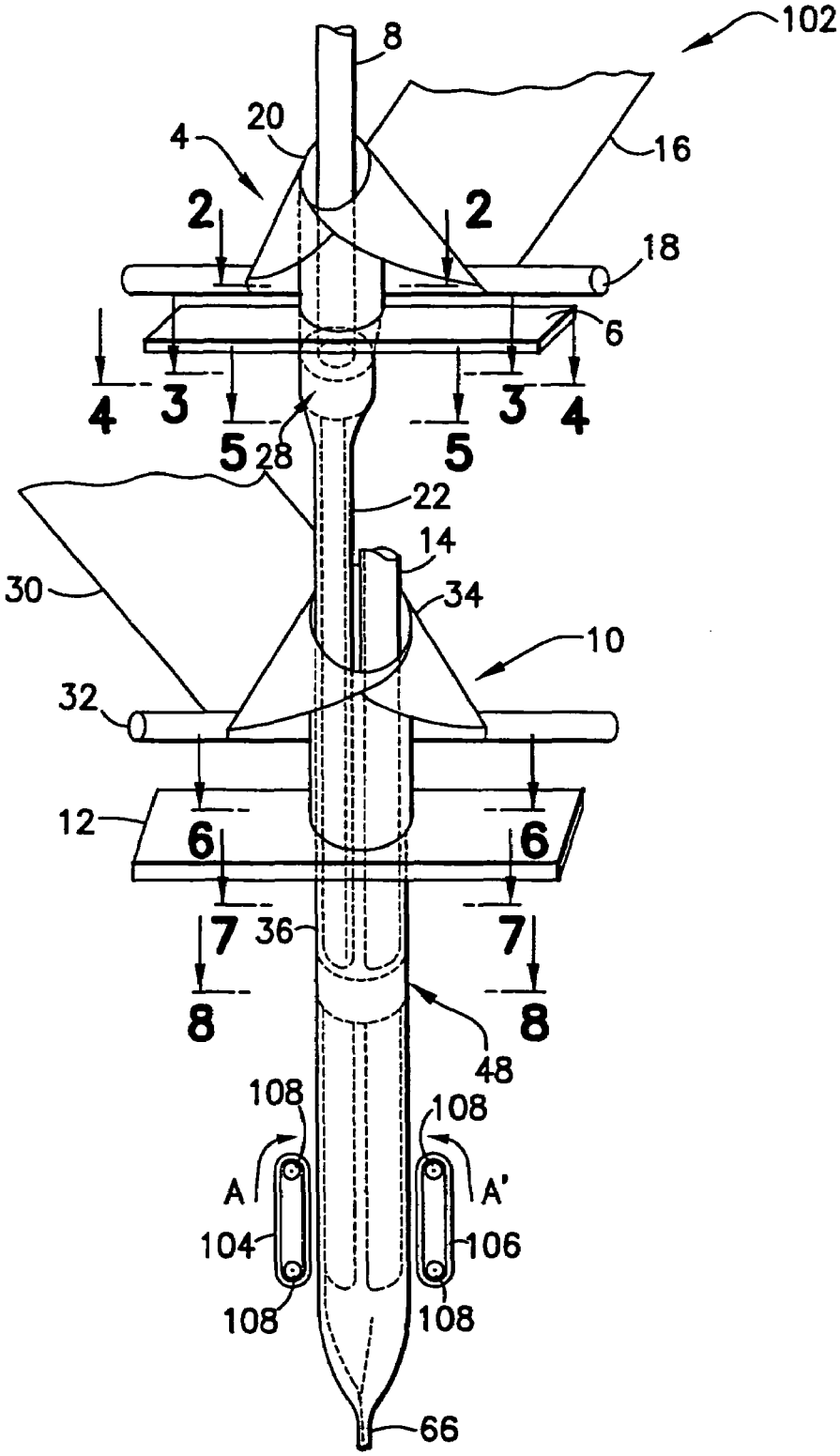
FIG. 12 is a perspective view of another embodiment of the packaging device of the present invention.

Another embodiment of the present invention is shown in FIG. 12. Apparatus 102 includes many of the same features and components as apparatus 2. At the lower end, a pair of endless belts 104, 106 traveling in respective directions A, A' over rollers or wheels 108 frictionally engage the outer tube 36. The outer tube 36 is engaged between the belt 104 and the first fill tube 8 in the vicinity of the overlapping portions 24 of inner tube 22. Likewise, the outer tube 36 engages between the belt 106 and the second fill tube 14 in the vicinity of the overlapping portions 38 of the outer tube 36. In another embodiment, the outer tube 36 is gripped and advanced by a continuous vacuum belt (not shown). Apertures through the vacuum belt permit a vacuum to be applied to the outer tube 36 so as to grip and advance the outer tube 36.

Figure 10:
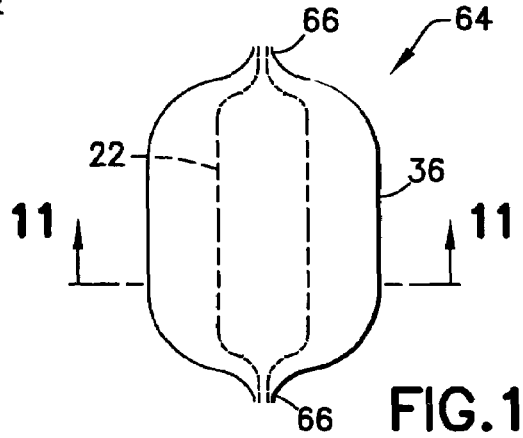
FIG. 10 is a side view of a two-component package produced according to the present invention.
Figure 11:
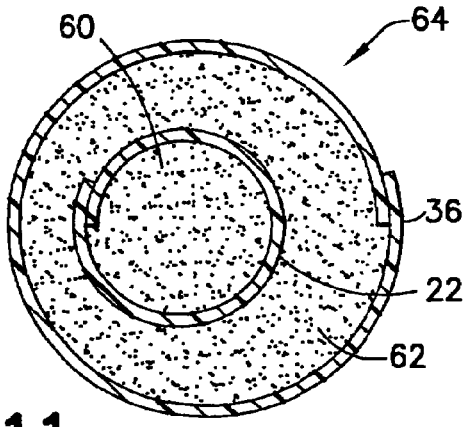
FIG. 11 is a cross-section of the package shown in FIG. 10 taken along line 11-11.

Referring to FIGS. 10 and 11, a first material 60 is delivered into the first fill tube 8 and a second material 62 is delivered into the second fill tube 14 such that a resulting two-component package 64 has a cross-sectional configuration generally as shown in FIG. 11. It has been found that active advancement of the outer tube 36 alone is needed to advance both the inner tube 22 and outer tube 36 and their contents through the apparatus 2 or 102. The outer tube 36 exerts drag on the second material 62 that, in turn, exerts drag on the inner tube 22 at a level sufficient to advance the inner tube 22 (and the first material 60) at a rate substantially the same as the rate of advancement of the outer tube 36. Substantially the same rate means that the outer tube 36 and the inner tube 22 advance at rates which do not produce undesirable tension or undesirable slack in the partitioned package 64 as can occur if one of the tubes advances more quickly than the other.

As shown in FIG. 10, the resulting two-component package 64 includes an inner tube 22 within an outer tube 36 constricted at each end 66. The two-component package 64 of the present invention may be produced from any heat-sealable, pliable film. The particular material selected for the webs 16 and 30 may be determined by the end-use of the two-component package 64. Polyethylene or polypropylene may be suitable for less aggressive environments where the risk of rupture or premature rupture is low. Stronger material is generally more costly but may be desirable in more aggressive environments such as in underground mining. In one embodiment, the outer tube 36 is produced from a stronger film while the inner tube 22 is produced from a weaker film. By using a weaker material for the inner tube 22, the force needed to puncture and shred the outer tube 36 will generally be sufficient to puncture and shred the inner tube 22. This ensures more effective mixing of reactive components. Accordingly, a resin cartridge produced according to the present invention provides for enhanced puncturability and mixing of the contents within the two tubes. A difference in strength between the outer tube 36 and inner tube 22 can be achieved by using a thinner film for web 16 than for web 30. For example, when both of webs 16 and 30 are produced from polyethylene terephthalate, the web 30 may be 0.0005 to 0.003 inch (0.5 to 3 mil) thick and the web 16 is 25 to 75% thinner than the web 30. Alternatively, a stronger material may be used for the web 30 than for the web 16, such as polyethylene terephthalate for web 30 and polyethylene or polypropylene for web 16. In such a case, the weaker web has a lower tensile modulus. It has been found that when the two-component package 64 of the present invention is produced using a material for the inner tube 22 having a lower modulus than the material of the outer tube 36, the inner tube 22 functions as a gasket to the outer tube 36 upon constriction and sealing of package 64 at the ends 66. Such an arrangement enhances the seal at the ends 66 of the package 64.

In addition, by using different materials for the inner tube 22 and outer tube 36, the tubes may have different vapor barrier properties. In a resin cartridge, to avoid loss of water from the catalyst compartment, the inner tube 22 may be produced from a material having low water permeability such as high-density polyethylene. Likewise, it can be beneficial for the outer tube 36 to exhibit low permeability to organic solvents present in a polymerizable resin composition. For example, polyester is one suitable material for the outer tube 36 to minimize permeation of organic materials therethrough. The structure of a resin cartridge produced according to the present invention is also beneficial to retaining the integrity of the resin cartridge. Water loss from a resin cartridge can make the cartridge limp and increases the viscosity of the components mixed. Minimized water loss improves the shelf life of the resin cartridge. Escape of water in the catalyst component from the resin cartridge is minimized because the catalyst component is surrounded by the inner tube 22, the polymerizable resin and outer tube 36.

In general, the first material 60 and the second material 62 are flowable materials such as fluids (typically liquids) and flowable solids such as powders or other particulate matter. For producing resin cartridges for use in anchoring mine roof bolts, the second material 62 may be a polymerizable resin such as a polyester resin and the first material 60 may be a polymerization catalyst. The sizes and relative dimensions of the inner tube 22 and outer tube 36 may vary depending on the end use of the two-component package 64. Mine roof resin cartridges typically have an overall diameter of about 0.75 to 1.5 inch and a length of 12 to 60 inches.

Whereas particular embodiments of this invention have been described above for illustration purposes, numerous varieties of the details of the present invention may be made without departing from the invention as defined in the appended claims.

The invention claimed is:

1. A process for producing a partitioned package comprising:

drawing a first web of a first film into a tubular configuration while overlapping edges of the web to produce an inner tube;

drawing a second web of a first film around the inner tube into a tubular configuration while overlapping edges of the second web to produce an outer tube;

filling the inner tube with a first material;

filling a gap between the inner tube and the outer tube with a second material that is different from the first material;

engaging only the outer tube such that the outer tube the outer tube is advanced, thereby causing the second material within the outer tube to advance and drag the inner tube along therewith at substantially the same rate as the outer tube; and constricting and sealing the advancing filled tubes at spaced apart locations and severing the sealed tubes at the seal locations to produce a package partitioning the first and second material.

2. The process of claim 1, wherein portions of the outer tube are engaged by an advancing surface.

3. The process of claim 2, wherein the advancing surface comprises a rotating wheel engaging portions of the outer tube.

4. The process of claim 2, wherein the advancing surface comprises a rotating belt engaging portions of the outer tube.

5. The process of claim 1, wherein the second material comprises a polymerizable resin composition and the first material comprises a polymerization catalyst.

6. The process of claim 1, wherein the inner tube is constricted within the outer tube.

7. The process of claim 1, wherein the outer tube has greater strength than the inner tube.

8. The process of claim 7, wherein the outer tube comprises polyethylene terephthalate.

9. The process of claim 8, wherein the inner tube comprises polyethylene or polypropylene.

* * * * *

UNITED STATES PATENT AND TRADEMARK OFFICE

CERTIFICATE OF CORRECTION

PATENT NO. : 7,681,377 B2
APPLICATION NO. : 11/472798
DATED : March 23, 2010
INVENTOR(S) : Simmons et al.

It is certified that error appears in the above-identified patent and that said Letters Patent is hereby corrected as shown below:

Column 6, Lines 24-25, Claim 1, "the outer tube the outer tube is advanced," should read
-- the outer tube is advanced, --

Signed and Sealed this

Sixth Day of July, 2010

David J. Kappos

David J. Kappos
*Director of the United States Patent and Trademark Office*